United States Patent [19]

Ohta et al.

[11] Patent Number: 5,031,720

[45] Date of Patent: Jul. 16, 1991

[54] SPEAKER DIAPHRAGM

[75] Inventors: Shuhei Ohta; Masakatu Sakamoto, both of Hachiohji; Shiro Iwakura, Hamuramachi; Yoshikazu Shirasaki, Nishinomiya; Ichiro Yoshida, Matubara, all of Japan

[73] Assignees: Kabushiki Kaisha Kenwood, Tokyo; Toyo Boseki Kabushiki Kaisha, Osaka, both of Japan

[21] Appl. No.: 276,940

[22] Filed: Nov. 28, 1988

[30] Foreign Application Priority Data

Dec. 1, 1987 [JP] Japan ..... 62-301421
Dec. 1, 1987 [JP] Japan ..... 62-301422
Dec. 1, 1987 [JP] Japan ..... 62-301423

[51] Int. Cl.[5] ..... G10K 13/00; H04R 7/00

[52] U.S. Cl. ..... 181/169; 428/260; 428/265; 428/272

[58] Field of Search ..... 181/169, 170; 428/260, 428/245, 265, 272, 252

[56] References Cited

U.S. PATENT DOCUMENTS 1,393,515 10/1921 Egerton ..... 181/169
4,291,781 9/1981 Niguchi et al. ..... 181/169
4,562,899 1/1986 Nakamura ..... 181/169

FOREIGN PATENT DOCUMENTS 49-29569 6/1974 Japan ..... 181/169
0115794 9/1980 Japan ..... 181/169
0048798 5/1981 Japan ..... 181/169
0182994 10/1983 Japan ..... 181/169
0194495 11/1983 Japan ..... 181/169
0130299 7/1985 Japan ..... 181/169
0087500 5/1986 Japan ..... 181/169

OTHER PUBLICATIONS

"Dyneema SK60" High Strength/High Modulus Fiber Properties and Applications (1987).

*Primary Examiner*—Brian W. Brown
*Attorney, Agent, or Firm*—Sixbey, Friedman, Leedom & Ferguson

[57] ABSTRACT

A speaker diaphragm is formed by heat-pressurized molding a composite structure of fabric cloth and resin sank into the fabric cloth. The fabric cloth is woven from high strength and high elasticity polyethylene fiber which has at least tensile modulus of 4,500 kg/mm$^2$ (500 g/d).

10 Claims, 3 Drawing Sheets

SPEAKER DIAPHRAGM

BACKGROUND OF THE INVENTION

1. Field of the Invention

The present invention relates to a speaker diaphragm which includes at least a layer formed by reinforcing a cloth woven from high strength and high elasticity fiber with resin.

2. Description of the Related Art

Conventionally, to the end of increasing the elasticity of acoustic diaphragm there was a speaker diaphragm formed by reinforcing a cloth of inorganic fiber such as carbon fiber with resin. Those conventional reinforced cloth, however, has relatively high specific gravity and thus it was impossible to fabricate a light acoustic diaphragm with high elasticity. In addition, while the specific elastic modulus is increased, due to the reduced internal loss the material colorations have become trouble at the high frequency region.

Conventionally, there was one material excellent only for a specific acoustic feature, but not material which can satisfy all the acoustic features required for a diaphragm. Accordingly, composite structure diaphragm formed by different characteristics materials have been studied.

In the past few years, a number of new materials have been developed for use in speaker diaphragms. One example is "plasma diamond," which Kenwood announced the development of in 1985. Others include strong of fibers made of materials such as carbon and Kevlar as well as plastics such as polypropylene.

None of these substances satisfy all of the conditions for the ideal diaphragm material which include (1) light weight (2) high sound velocity and rigidity (3) sufficient internal loss. Therefore, efforts are being made to create a balance of the desirable properties of these substances by combining them with other materials.

Composites offer us the opportunity to create diaphragm materials with properties possessed by no one single substance. It is possible to develop materials which balance opposing properties, for diaphragms which are both strong and lightweight, or strong without ringing. We have been conducting research into composite diaphragm materials for many years. Our quest for natural sound reproduction free from unwanted colorations has led to the development of the "HR carbon diaphragm," which features a laminated construction incorporating carbon, which possesses excellent sound velocity and rigidity, and a damping layer to guarantee sufficient internal loss and inhibit the ringing to which carbon is prone. Also notable is the "polygonal carbon ceramic diaphragm" in which the carbon is reinforced by ceramic particles. However, as carbon fiber is the principle material in both of these diaphragms, there are practical limits to how much the weight can be reduced.

Recently, polyethylene fiber is drawing the attention as acoustic diaphragm material due to its high internal loss and good transient characteristics.

For instance, Japanese Laid-Open Gazette No. 58-182994 discloses the diaphragm fabrication method wherein short length polyethylene fibers with the longitudinal wave propagation velocity over 4,000 m/sec are made into a paper-like layer in wet-papering manner. However, since this paper-like layer comprises short length fibers, the tensile elastic modulus in one particular direction of the paper-like layer has disadvantageously become one third the inherent polyethylene tensile elastic modulus.

Japanese Laid-Open Gazette No. 62-157500 proposes the skin layer formation of polyethylene film and composite structure of laminated polyethylene film sheet and fabric. In laminating the polyethylene film on the fabric, due to the weak adhesion of the polyethylene film the lamination structure is very weak in the shear direction. For instance, a large power input to the speaker unit may cause peeling at the interface of the laminated layers due to the amplitude exhaustion.

Most of the conventional acoustic diaphragm for speaker units have been formed from paper pulp. While the paper pulps have an appropriate internal loss, their characteristics are insufficient for elasticity, strength and rigidity so that divided vibrations take place at a low frequency region. Such divided vibration disadvantageously causes peak and dip in the frequency characteristics curve which brings colorations. Conventionally, to the end of improving the paper pulp acoustic diaphragm characteristics, the composite structures of paper pulp layer and inorganic fiber FRP layer such as carbon fiber have been proposed. Even such composite structure, it was difficult to eliminate the peak and dip in the frequency characteristics curve.

Accordingly, the objective of the present invention is to provide an acoustic diaphragm which has appropriately well-balanced characteristics for speaker units.

SUMMARY OF THE INVENTION

A speaker diaphragm according to the present invention comprises a fabric woven from high strength and high elasticity polyethylene fiber which has at least tensile elastic modulus of 4,500 kg/mm$^2$ (500 g/d) and resin sank into the fabric, wherein the fabric and resin are subjected to a heat-pressurized molding process to be an unitary structure.

In the embodiment, a specifically processed polyethylene fiber called Dyneema SK60 (Toyobo, Trade name) is used as the high strength and high elasticity polyethylene fiber.

Dyneema SK60 is built up of transparent fibers with an opaque white appearance in the multi-filament yarn. Its key properties are high tensile strength and modulus or, better tenacity and specific modulus. It is excellent in specific strength vs. specific modulus.

As the basic material of Dyneema is high performance polyethylene it is the only fiber with a density below 1, which means that is floats on water. Dyneema SK60, combines high values for several properties with a low density.

The speaker diaphragm further comprises a back layer laminated to the unitary structure of polyethylene fiber fabric and resin, the back layer being woven from at least one selected from a group of carbon fiber, glass fiber, silicon carbide fiber, fully aromatic polyamide fiber and fully aromatic polyester fiber, or being a paper pulp.

In one type of fabric applied to the present invention, the fabric is mixedly woven from a first yarn of high strength and high elasticity polyethylene fiber and longitude yarn of a second yarn of fiber different in characteristics from the first fiber.

The acoustic diaphragm according to the present invention, which includes fabric woven from high strength and high elastic polyethylene fiber, is well-balanced for acoustic characteristics required to a speaker of strength, tensile elasticity, rigidity, lightness and internal loss, as compared with each of conventional acoustic diaphragm-materials, so that the frequency characteristics curve can become flat at the high frequency region and the material colorations at the high frequency can be suppressed effectively.

DESCRIPTION OF THE PREFERRED

Embodiments 1, 2, 3 and 4

Figure 1:
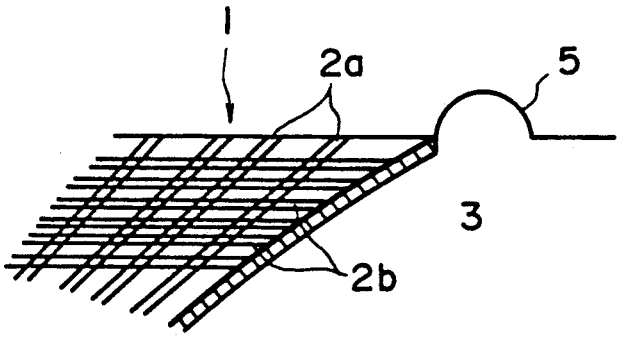
FIG. 1 is a perspective view showing the structure of a speaker diaphragm relating to embodiments 1 to 4 according to the present invention.

FIG. 1 shows a cone-shape molded diaphragm 1 which comprises a single layer or laminated layers constructed by fabric 2 (*2a, 2b*) and resin 3. Fabric 2 is a cloth (density; latitude, longitude 18 lines/inch) which is plain-woven from yarn of 800 denier/750 filaments of high strength and high elasticity polyethylene fiber (Toyo Boseki KK, Trade Name; DYNEEMA SK-60) which has tensile intensity of 33 g/d and tensile elastic modulus of 1270 g/d. This cloth was processed by a prepreg treatment with vinyl-ester resin (hereafter called PE prepreg cloth) by sinking the vinyl-ester resin into the fabric. Two sheets of PE prepreg cloth were laminated and subjected to a heat-pressurized molding with a predetermined hardening conditions (120 ° C., 5 minutes, face pressure 5 kg/cm$^2$) to produce a 8 inch cone-shape diaphragm 1.

Dyneema SK60 is produced via a unique gel spinning process the first product from which is high performance polyethylene.

Gel spinning derives its name from the gel-like appearance of the spun/quenched filaments. In this process ultra-high molecular weight polyethylene is dissolved in a volatile solvent and then spun through a spinnerette. In the solution the molecules become disentangled and remain so in the fiber. As the fiber is drawn, a very high level of macromolecular orientation is attained. Dyneema SK60 is characterized by a parallel orientation greater than 95% and a high level of crystallinity. This gives Dyneema SK60 unique properties that cannot be attained by other processes.

Dyneema SK60 is built up of transparent fibers with an opaque white appearance in the multi-filament yarn. Its key properties are high tensile strength and modulus or, better tenacity and specific modulus. It is excellent in specific strength vs. specific modulus.

Dyneema has the highest specific strength of man-made fibers and is only exceeded in specific modulus by carbon fibers. Dyneema SK60 will typically be produced at a specific strength of 2.7 N/tex and 90 N/tex specific modulus.

As the basic material of Dyneema is high performance polyethylene it is the only fiber with a density below 1, which means that is floats on water. Dyneema SK60, combines high values for several properties with a low density.

The FRP-characteristics of the above products can exhibit sound velocity of 2800 m/sec, internal loss tan $\delta$ of 0.03 and specific gravity of as small as 0.9.

The sound velocity of 2800 m/sec is slightly smaller than 3500 m/sec for carbon fiber plain-woven FRP diaphragm. It, however, is necessary to obtain moderately balanced characteristics of factors required for acoustic diaphragms. Referring to the aspect of (sound velocity$\times$internal loss), the diaphragm of this embodiment 1 has a value of (2800 m/sec$\times$0.03) which is larger than (3500 m/sec$\times$0.01) for conventional carbon fiber plain-woven FRP diaphragm. Accordingly, the diaphragm of this embodiment 1 is more appropriate material for acoustic diaphragms.

The same cloth as that of embodiment 1 and resin of unsaturated polyester (120° C., 5 minutes hardening) were processed in the same molding manner as that of embodiment 1 to produce another 8 inch cone diaphragm as embodiment 2.

For the FRP characteristics of the above products of embodiment 2, while the sound velocity is 2800 m/sec and unchanged from embodiment 1, the internal loss tan $\delta$ becomes 0.07 to 0.08 which is twice as large as embodiment 1. The specific gravity was 1.0.

From the results of embodiments 1 and 2, it was turn out that the high intensity and high elasticity polyethylene fiber does not deteriorate the sound velocity even in a composite with a resin which elevates the internal loss.

In the same manner as that of embodiment 1, as embodiment 3 on 8 inch cone-shape diaphragm was molded in a heat-pressurizing manner by using a single sheet of PE prepreg cloth (weight, 205 g/m$^2$) which was prepreg-processed with resin for a plain-woven cloth of 16 lines/inch in latitude and 18 lines/inch in longitude from yarn of 600 denier/240 filament of high intensity and high elasticity polyethylene fiber which has tensile intensity of 31 g/d and tensile elastic modulus of 1150 g/d. The produced cone diaphragm the weight of which is about 5.5 g was assembled into a 8 inch speaker unit.

To the end of evaluating the frequency characteristics of the above cone diaphragm, a conventional carbon fiber plain-woven FRP diaphragm was made by using a plan-woven prepreg cloth (hereinafter called DF prepreg cloth) which includes a carbon cloth in both of latitude and longitude = 18 lines/inch from yarn of 1000 filament carbon fiber, and was assembled into a 8 inch speaker unit. The resin of CF prepreg cloth was the same as that of embodiment 1, the weight of the diaphragm was 5.5 g.

Figure 3:
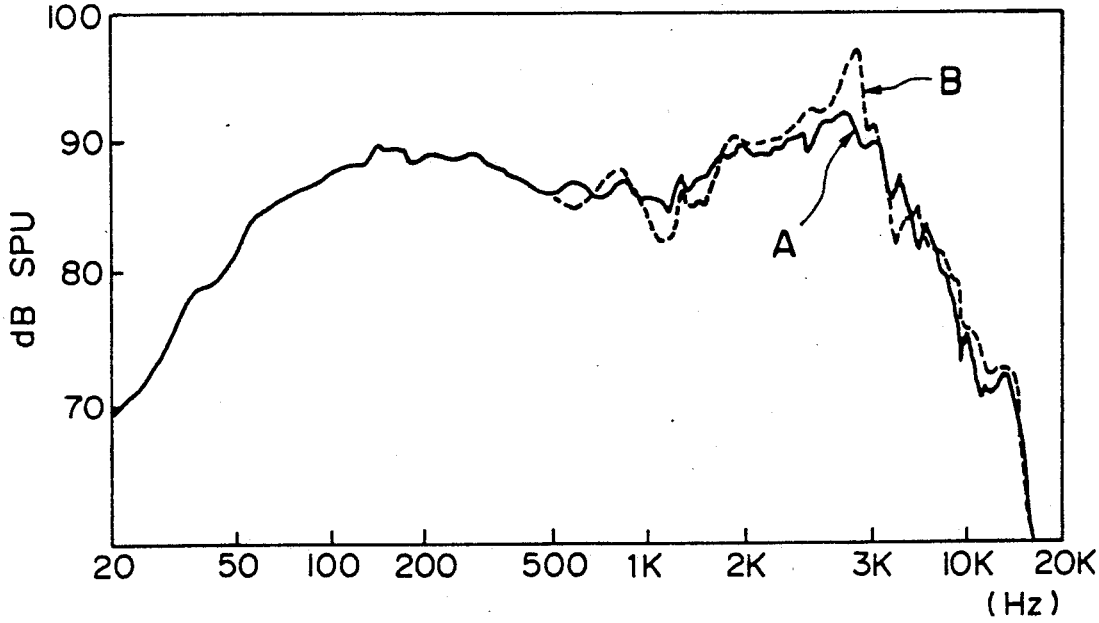
FIG. 3 shows the frequency characteristics curves A and B for the embodiment 3 according to the present invention and conventional carbon fiber FRP diaphragm.

In FIG. 3, A and B respectively are the frequency characteristics curves for the speaker unit of embodiment 3 and the speaker unit of the conventional carbon fiber plain-woven FRP diaphragm. From the curves, it was turn out that the frequency curve of A is significantly flattened in its high frequency region, as compared with that of B.

In the same manner as that of embodiment 1, 4 inch mid-range diaphragm was mold by using a single sheet of prepreg cloth which was prepreg-processed with resin and plain-woven cloth from yarn which has the intensity of 300 kg/mm$^2$ and elastic modulus of 13000 kg/mm$^2$ and was assembled into a 4 inch mid-range speaker. The specific gravity of the diaphragm was as light as 0.9. As compared with the conventional carbon fiber plain-woven FRP mid-range diaphragm, due to the light weight the efficiency is improved and a smooth frequency curve could be obtained in the high frequency region.

The usefulness percentage in the yarn used in embodiments 1 to 4 is still low for either of intensity or elastic modulus. They are respectively 10% for intensity and 50% for elastic modulus. If the improved technique makes them approach to 100%, the sound velocity will become 16490 m/sec for polyethylene theoretical elastic modulus of 24975 kg/mm$^2$.

For improved elasticity material, it is effective to fabricate a straight cone diaphragm by laminating a plurality of unidirectional layers with different angles for the purpose of raising the sound velocity.

Figure 2:
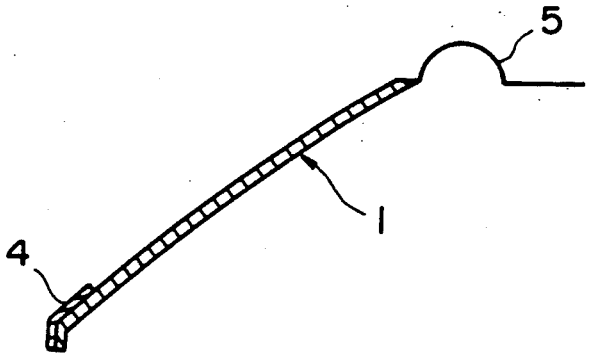
FIG. 2 is a sectional view for the structure of FIG. 1.
Figure 5:
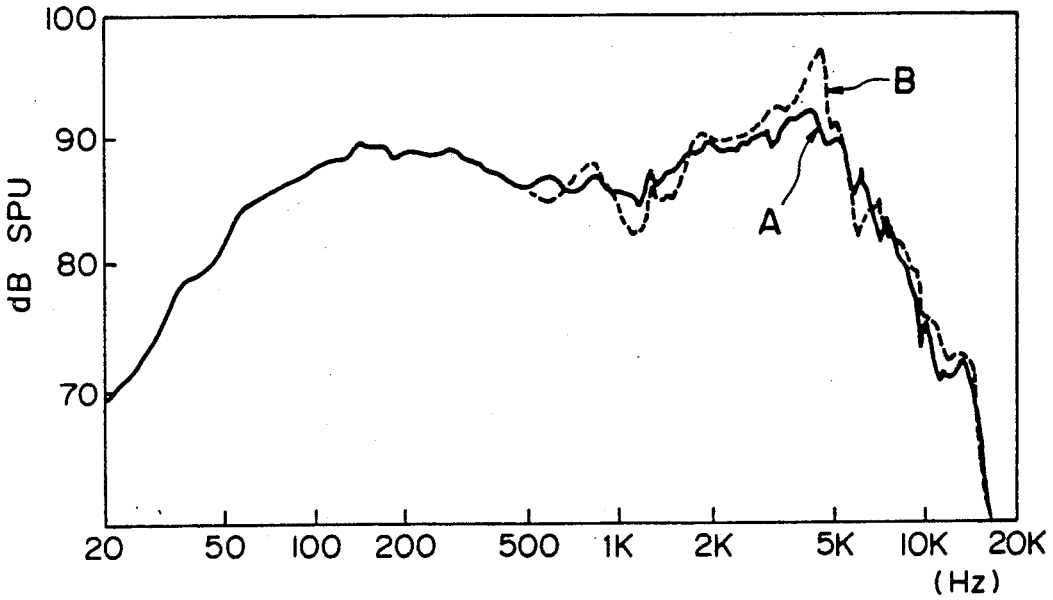
FIG. 5 shows the frequency characteristics curves A and B for the embodiment 6 according to the present invention and conventional carbon fiber FRP diaphragm.

Since the heat resistance temperature of material is 150° C., when high power resistance ability is required (where the maximum input power has driven a metal voice coil bobbin to contact with the diaphragm), as shown in FIG. 2 it is preferable to provide partial laminate plate 4 of heat resistance fiber such as silicon carbide (SiC) fiber at the neck part of cone diaphragm 1. While the above mentioned yarn is substantially transparent, it is possible to dye the yarn or mix dye or pigment into the resin for the purpose of heightening the products quality. In FIG. 1 and FIG. 2, 5 is an edge damper of the speaker unit.

The diaphragms of embodiments 1 to 4 are molded with resin and cloth woven from polyethylene fiber which has tensile intensities over 20 g/d (g/d=9.0 kg/mm$^2$), and have smaller specific gravity as well as superior intensity and elasticity. The smaller specific gravity can bring a lighter diaphragm. In addition, as compared with the conventional inorganic reinforced plastic diaphragm, the internal loss of the diaphragm in the embodiments 1 to 4 is larger and thus can suppress the material hissing which causes irregularity in the frequency curve in high frequency region. This large internal loss may result from the mutual reaction of the selected fiber and resin.

Embodiments 5 and 6

Figure 4:
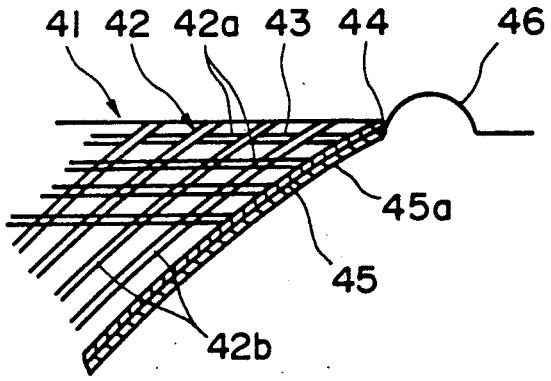
FIG. 4 is a perspective view showing the structure of a speaker diaphragm relating to embodiments 5 and 6 according to the present invention.

In FIG. 4, 41 designates the whole construction of embodiments 5 of a composite cone-molded diaphragm which is fabricated by laminating front layer 44 and back layer 45. The front layer 44 is produced from fiber yarn 42*a* and resin 43 by working PE prepreg cloth made in the same material and manner as those of embodiments 1 to 4. The back layer 45 is produced from carbon fiber yarn 45*a* by working CF prepreg cloth made through prepreg-processing on vinyl-ester resin 43 (hardened for 5 minutes at 120° C.) and plain-woven cloth of 3000 filament carbon fiber (density; latitude, longitude 13 lines/inch). An 8 inch cone diaphragm 41 was obtained by heat-pressurized molding the laminated front and back layer in a predetermined hardening conditions (120° C., 5 minutes, face pressure 5 kg/cm$^2$). Accordingly, the cone diaphragm 41 of FIG. 4 has a lamination structure comprising the front layer 44 including high strength and high elasticity polyethylene fiber 42*a* and resin and the back layer 44 including inorganic fiber FRP 45*a* such as carbon fiber.

The characteristics of the above lamination structure diaphragm has sound velocity of 3500 m/sec and internal loss tan δ of 0.025 which are ideal values. In the thickness of 0.5 mm, the specific elastic modulus and also specific rigidity factor were excellent.

In a lamination structure diaphragm of embodiment 6, a front layer is produced by working PE prepreg cloth made in the same manner as those of embodiments 1 to 4 and a back layer is a paper pulp cone (thickness 0.4 mm, weight 6 g). An 8 inch cone diaphragm was obtained by laminating the PE prepreg cloth to the previously molded paper pulp cone set on a hot press.

The characteristics of the above lamination structure diaphragm has sound velocity of 2700 m/sec and internal loss of 0.035. Since the thickness is as thick as 0.65 mm and the specific gravity is as light as 0.7, the diaphragm exhibited a high strength and also high rigidity.

In the characteristics measurement for speaker units assembled with the above lamination structure diaphragms of embodiments 5 and 6, as compared with speaker units of the conventional paper pulp cone diaphragm an enlarged piston motion range could be recognized and the irregularity of peak and dip was reduced due to the reduced divided vibration.

To the end of evaluating the frequency characteristics of the lamination structure cone diaphragm of embodiment 6 assembled in a speaker unit, a lamination structure cone diaphragm of a carbon fiber plain-woven FRP layer as a front layer and a paper pulp layer was made. The carbon fiber plain-woven cloth is CF prepreg cloth which includes a carbon cloth in both of latitude and longitude=18 lines/inch of 1000 filament carbon fiber. The resin of CF prepreg cloth was the same as that of embodiment 6. In the same manner of embodiment 6, the CF prepreg cloth and paper pulp cone (thickness 0.4 mm, weight 6 g) were laminated and processed by a heat-pressurized molding.

In FIG. 5, A and B respectively are frequency characteristics curves for the speaker unit of embodiment 6 and the speaker unit of the lamination structure-carbon fiber diaphragm. From the curves, it was turn out that the frequency curve of A is significantly flattened in its high frequency region, as compared with that of B.

The diaphragms of embodiments 5 and 6 have a larger internal loss which can suppress the material colorations and flatten the characteristics curve at the high frequency region, as compared with the lamination structure diaphragm including the conventional inorganic fiber enforced plastic layer.

Embodiments 7 and 8

In the above embodiments 1 to 6, the plain-woven cloth is woven front one kind of yarn of polyethylene fiber which has tensile intensity over 20 g/d and tensile elastic modulus over 500 g/d.

Figure 6:
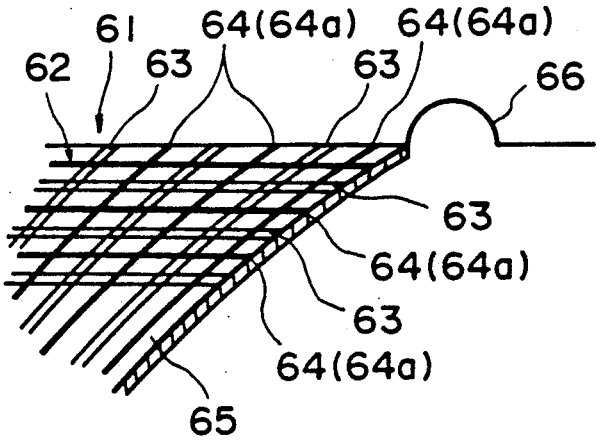
FIG. 6 and FIG. 7 show the structures of diaphragm of embodiments 7 and 8 according to the present invention.

Embodiment 7 shown in FIG. 6 is a diaphragm 61 prepreg-processed with resin 65 and cross-woven cloth 62. The cross-woven cloth 62 is mixedly woven from one type of fiber; high strength and high elasticity polyethylene yarn 63 with elastic modulus over 4500 kg/mm$^2$ and another type of high strength and high elasticity yarn 64 (64*a*). The diaphragm 61 is assembled into a speaker unit with damping edge 66.

The one type of fiber 63 is a yarn of 1600 denier/1500 filament of high strength and high elasticity polyethylene fiber (Toyo Boseki KK, Trade Name DYNEEMA SK-60) and has an elastic modulus of 10,000 kg/mm$^2$. Another type 64 is a yarn of 3000 filaments of carbon fiber 4a with elastic modulus of 24,000 kg/mm$^2$. The cross-woven cloth 2 is plain-woven from the above polyethylene fiber yarn 63 and carbon fiber yarn 64 and the ratio of yarns 63 and 64 is 1:1 for latitude and longitude with the density of 13 lines/inch.

The above cross-woven cloth is prepreg-processed with vinyl-ester resin and formed into an 8 inch cone diaphragm 61 in a predetermined conditions (120 ° C., 5 minutes, face pressure 5 kg/cm$^2$) through heat-pressurized molding.

The characteristics of the prepreg-processed cross-woven cloth diaphragm has the sound velocity of 3500 m/sec and internal loss tan δ of 0.04 which are well balanced for acoustic diagram requirements. The specific gravity was as small as 1.2. The material colorations was reduced without deteriorating the efficiency.

The "Cross Dyneema Diaphragm," made of a composite material composed of Dyneema fibers and highly rigid carbon fibers possess exceptional properties not obtainable using any single substance. The principle features of Cross Dyneema Diaphragms are:

1. Light weight and high rigidity

Factors effecting diaphragm rigidity include the Young's modulus and thickness. However, in contrast to the other factors, the cube of the thickness is directly proportional to the rigidity, meaning that making the diaphragm thicker has a dramatic effect on its rigidity. Dyneema's specific gravity of only 0.97 means that even if we increase the thickness for greater rigidity, we can create a composite diaphragm 20 percent lighter than conventional carbon, thereby increasing speaker efficiency.

2. High sound velocity

Being a composite containing rigid carbon, Cross Dyneema Diaphragms are comparatively elastic. Also, since the sound velocity of Dyneema is equivalent to that of carbon, a balanced construction can be achieved. Cross Dyneema Diaphragms possess a high sound velocity of 3600 m/sec., giving them excellent resistance to cone breakup. The range of pistonic motion is extended providing better high frequency response.

3. High internal loss

The internal loss tan. δ of conventional carbon diaphragms was only on the order of 0.006, meaning that there was a peak in the frequency response in the treble range. This necessitated special corrective measures when creating systems. Dyneema fiber, on the other hand, possesses high internal loss. The internal loss of Cross Dyneema composite diaphragms is a practically ideal 0.028. This means there are virtually no high frequency peaks, making seamless integration with the other driver units possible.

4. Excellent resistance to environmental factors

Cross Dyneema Diaphragms stand up well to environmental factors such as light, humidity and moisture.

A comparison of Cross Dyneema Diaphragms and conventional carbon diaphragms is given below.

| | Sound Velocity (m/s) | Tan δ | Density (g/cm$^3$) |
|---|---|---|---|
| Cross Dyneema Diaphragm | 3,600 | 0.028 | 1.17 |
| Conventional Carbon Diaphragm | 3,300 | 0.006 | 1.42 |

Figure 7:
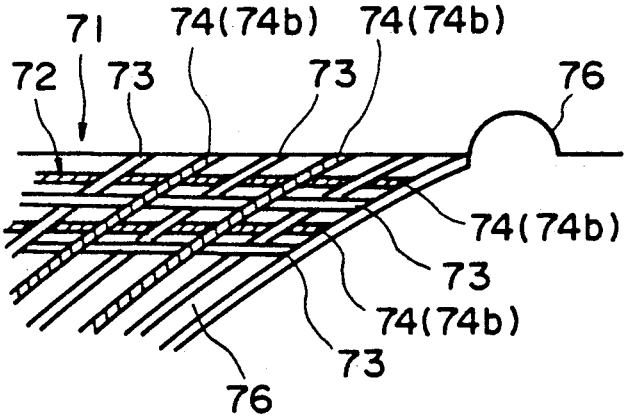

In embodiment 8 as shown in FIG. 7, fully aromatic polyamide fiber 74b is used for high strength and high elasticity fiber 74. The specific gravity for such fully aromatic polyamide type of fiber is 1.45. The diaphragm which uses a cloth cross-woven with the above polyamide fiber 74 and high strength and high elasticity polyethylene fiber 73 (specific gravity 0.97) has the specific gravity of 1.1. In this case, the diaphragm becomes lighter and the specific elastic modulus and specific rigidity become higher.

Highly extended polyvinyl-alcohol (PVA) fiber or highly extended olefinic fiber (polypropylene fiber, etc.) can be used for high strength and high elasticity fiber 94. The above illustrated fiber can bring still lighter diaphragms.

The cross-weaving ratio can be adjusted according to the required sound quality.

The PE prepreg cloth including the cross-woven fabric can constitute a diaphragm by itself with another type of PE prepreg cloth such as aforementioned embodiments or with a different type of cloth such as carbon fiber cloth.

Through experiments, it has found out that polyethylene fibers applied to the acoustic diaphragm should have at least tensile intensity over 20 g/d, preferably over 30 g/d, and at least tensile elastic modulus over 500 g/d, preferably over 1000 or 1300 g/d.

The denier of a polyethylene fiber filament applied to the acoustic diaphragm is preferably selected from the range of 0.2 to 20, more preferably the range of 0.5 to 10.

The cloth applied to the acoustic diaphragm can be either of woven fabric, non woven fabric or knit. However, in the aspect of the balance of elasticity and internal loss, woven fabric is preferable.

The total denier of polyethylene fiber yarn should be selected from the range of 300 to 1600 d, preferably the range of 800 to 1600.

In the diaphragm, the PE prepreg cloth can be either of a single layer or laminated structure with another layer of the same PE prepreg cloth or different material layer such as carbon fiber layer (CF prepreg cloth) and paper pulp layer. For PE prepreg cloth woven from thin polyethylene fiber yarn, the laminated structure is preferable.

What is claimed is:

1. A speaker diaphragm comprising fabric and thermoset resin sunk into said fabric, the fabric being woven to constitute a matrix in a diaphragm, characterized in that said fabric is of polyethylene fiber, said thermoset resin is of vinyl-ester and/or unsaturated polyester, and a sound velocity of the diaphragm is at least 2,800 m/sec.

2. A speaker diaphragm according to claim 1, wherein said fiber is high strength and high elasticity polyethylene fiber which has at least tensile strength of 180 kg/mm$^2$ (20 g/d).

3. A speaker diaphragm according to claim 1, wherein the diaphragm is molded into a cone having a neck and a heat-resistance layer is laminated at a neck part of the cone.

4. A speaker diaphragm according to claim 1 further comprising a back layer laminated to said unitary structure of polyethylene fiber fabric and resin.

5. A speaker diaphragm according to claim 4, wherein said back layer is a resin layer reinforced by fabric woven from at least one selected from a group of carbon fiber, glass fiber, silicon carbide fiber, fully aromatic polyamide fiber and fully aromatic polyester fiber.

6. A speaker diaphragm according to claim 4, wherein said back layer is a paper gulp layer.

7. A speaker diaphragm according to claim 1, wherein said fabric is cross-woven from a first yarn of high strength and high elasticity polyethylene fiber and a second yard of fiber different in characteristics from said polyethylene fiber.

8. A speaker diaphragm according to claim 7, wherein the fiber of said second yarn is a carbon.

9. A speaker diaphragm according to claim 7, wherein the fiber of said second yarn is fully aromatic polyamide.

10. A speaker diaphragm according to claim 7, wherein the fiber of said second yarn is a highly extended polyvinyl alcohol.

* * * * *